US009485848B2

(12) United States Patent
Lacoste et al.

(10) Patent No.: US 9,485,848 B2
(45) Date of Patent: Nov. 1, 2016

(54) GLOW DISCHARGE LAMP

(71) Applicants: CENTRE NATIONAL DE LA RECHERCHE SCIENTIFIQUE (CNRS), Paris (FR); UNIVERSITE JOSEPH FOURIER—GRENOBLE 1, St. Martin d'Hères (FR)

(72) Inventors: Ana Lacoste, Saint Martin le Vinoux (FR); Jacques Pelletier, St. Martin d'Hères (FR)

(73) Assignees: Universite Joseph Fourier—Grenoble 1, St. Martin d'Heres (FR); Jacques Pelletier, Saint Martin d'Heres (FR)

( * ) Notice: Subject to any disclaimer, the term of this patent is extended or adjusted under 35 U.S.C. 154(b) by 0 days.

(21) Appl. No.: 14/413,820

(22) PCT Filed: Jul. 10, 2013

(86) PCT No.: PCT/EP2013/064583
§ 371 (c)(1),
(2) Date: Jan. 9, 2015

(87) PCT Pub. No.: WO2014/009414
PCT Pub. Date: Jan. 16, 2014

(65) Prior Publication Data

US 2015/0137682 A1 May 21, 2015

(30) Foreign Application Priority Data

Jul. 11, 2012 (FR) ..... 12 56672

(51) Int. Cl.
*H01J 7/24* (2006.01)
*H05H 1/46* (2006.01)
(Continued)

(52) U.S. Cl.
CPC ..... *H05H 1/46* (2013.01); *H01J 61/327* (2013.01); *H01J 61/54* (2013.01); *H01J 61/78* (2013.01);
(Continued)

(58) Field of Classification Search
CPC ..... H01J 61/64; H01J 61/36; H01J 61/86; H01J 61/125; H01J 61/327; H01J 2201/00; H01J 2201/2821; H05H 1/46; H05H 2001/4607; H05H 2001/4645; H05H 2001/4652; H05H 2001/4697; H05H 2001/466; H05H 1/24; H01S 3/097; H01S 3/09705; H01S 3/0975
USPC ..... 313/619, 623, 632, 637, 641, 631; 315/111.21, 111.51, 111.71; 356/316; 372/55, 76
See application file for complete search history.

(56) References Cited

U.S. PATENT DOCUMENTS 3,931,589 A * 1/1976 Aisenberg ..... H01S 3/09707 315/5.38
5,027,030 A * 6/1991 Bouchard ..... H01J 61/64 313/619
(Continued)

FOREIGN PATENT DOCUMENTS

CN 2800483 Y 7/2006
CN 101834111 A 9/2010
(Continued)

OTHER PUBLICATIONS

Seidelmann, L., et al.; "New Discharge Tube With Virtual Cathode;" Acta Physica Slovaca, vol. 53, No. 5, Jan. 1, 2003; pp. 407-411.
(Continued)

*Primary Examiner* — Haissa Philogene
(74) *Attorney, Agent, or Firm* — Harness, Dickey & Pierce, P.L.C.

(57) ABSTRACT

The disclosure includes a glow-discharge lamp including: an elongate casing transparent to illuminating radiation and containing a plasma gas; a device for applying an electric field for maintaining a plasma in the so-called positive column region of the casing, the device including two electrodes forming an anode and a cathode located in the casing at each end thereof; and a radio-frequency or micro-wave cathode plasma source arranged in the casing in relation to the cathode-forming electrode, such as to generate a high-frequency discharge located on the surface of the electrode in order to generate the plasma. The disclosure also includes a lighting method of such a glow-discharge lamp.

22 Claims, 4 Drawing Sheets

(51) Int. Cl.

| | |
|---|---|
| ***H01J 61/32*** | (2006.01) |
| ***H01J 61/54*** | (2006.01) |
| ***H01J 61/78*** | (2006.01) |
| ***H05H 1/48*** | (2006.01) |
| ***H05H 1/50*** | (2006.01) |

(52) U.S. Cl.
CPC ..... *H05H 1/48* (2013.01); *H05H 1/50* (2013.01); *H05H 2001/4607* (2013.01); *H05H 2001/4652* (2013.01)

(56) References Cited

U.S. PATENT DOCUMENTS

| | | | | |
|---|---|---|---|---|
| 6,194,833 | B1 * | 2/2001 | DeTemple | G03F 7/70016 313/356 |
| 6,433,480 | B1 * | 8/2002 | Stark | H01J 61/09 313/306 |
| 6,902,646 | B2 * | 6/2005 | Mahoney | H01J 37/32954 118/712 |
| 7,574,974 | B2 | 8/2009 | Lagarde et al. | |

FOREIGN PATENT DOCUMENTS

| | | | |
|---|---|---|---|
| EP | 0593312 | A2 | 4/1994 |
| GB | 2180094 | A | 3/1987 |
| GB | 2271117 | A | 4/1994 |
| JP | 2003086388 | A | 3/2003 |

OTHER PUBLICATIONS

Latrasse, L., et al.; "High Density Distributed Microwave Plasma Sources in a Matrix Configuration: Concept, Design and Performance;" Plasma Sources Science and Technology, vol. 16, No. 1, Feb. 2007; pp. 7-12.

Chen, Francis F.; "Plasma Ionization by Helicon Waves;" Plasma Physics and Controlled Fusion, vol. 33, No. 4, Apr. 1991; pp. 339-364.

Kaisser, Walter, et al; "Impact of Current Crest Factor at High and Low Frequency Operation on Fluorescent Lamp Electrodes;" The 2006 IEEE Industry Applications Conference Forty-First IAS Annual Meeting, Conference Record, Piscataway, New Jersey, United States, XP031026040, Oct. 1, 2006; 6 pages.

Fehsenfeld, F.C. et al.; "Microwave Discharge Cavities Operating at 2450 MHz;" The Review of Scientific Instruments, vol. 36, No. 3, Mar. 1965; 6 pages.

* cited by examiner

GLOW DISCHARGE LAMP

CROSS-REFERENCE TO RELATED APPLICATIONS

This application is a National Phase Entry of International Application No. PCT/EP2013/064583, filed on Jul. 10, 2013, which claims priority to French Patent Application Serial No. 1256672, filed on Jul. 11, 2012, both of which are incorporated by reference herein.

TECHNICAL FIELD

The present invention relates to a glow discharge lamp and to a lighting method which can be implemented in such a lamp.

BACKGROUND

Within the framework of energy saving for the struggle against global warming, different types of so-called low-power-consumption lamps have been developed to replace incandescent lamps wherein more than 90% of the energy consumed is not converted into light. Among the new types of low-power-consumption lamps offered on the market should mainly be mentioned glow discharge lamps, of which the two principal embodiments are commonly called "neon" tubes and compact fluorescent lamps. In general terms, electrode fluorescent lamps are based on the emission of ultraviolet (UV) rays, generated inside a tube that is linear (neon tube) or folded back on itself (compact fluorescent lamp), by a periodic low-frequency discharge (50 or 60 Hz for example), the UV being transformed into visible light by phosphors covering the inside of the tube. The gas mixtures generally used are mixtures of rare gases (mainly argon) seeded with mercury, an active element with principal UV emission lines situated at 254 nm (the biggest line), 297 nm, 313 nm and 365 nm (UVA) (not an exhaustive list), wavelengths at which the fluorescence efficiencies, that is the conversion of photons into visible light on the phosphors lining the inside of the lamps, are highest.

Glow discharge lamps comprise two electrodes (anode and cathode) located at the end of a sealed tube filled with a gas mixture (rare gases and mercury) under low pressure, on the order of a mbar or a torr (1 torr=133 Pascal). The plasma is obtained by applying a voltage between the two electrodes.

FIG. 1 illustrates the distribution of the electric field E along a direct current glow discharge, the abscissa extending from the cathode (z =0) toward the anode (z=L, the length of the tube). In such a discharge, the most effective plasma production zone from the energy standpoint consists of the region R2, called the positive column, along which the axial electrical field adjusts itself so that the power given up by the electric field to the electrons e for maintaining the plasma allows exact compensation of radial plasma losses on the walls along the positive column, this so as to keep the discharge ignited. In the region of the cathode (called cathode region R1), on the other hand, there appears a very strong voltage drop (more than two or three hundred volts) which makes it possible to accelerate the ions i of the discharge toward the cathode, thus creating secondary electrons $e_2$ which in their turn are injected into the gas with high energy, thus allowing ionization of the gas mixture.

A so-called negative glow region R3, where the electric field is practically null and which constitutes a diffusion space for the plasma and a drift space for secondary electrons not yet thermalized, is situated between the cathode region R1 and the positive column R2. Finally, region R4 located in proximity to the anode, where the electrons at the edge of the positive column R2 are accelerated toward the anode, is called the anode sheath. In the case of 50 or 60 Hz AC voltage, the electrodes are reversed at each alternation.

If a glow discharge is considered, the cathode region, where the electrode is polarized very negatively with respect to the anode, corresponds to a region where a great energy loss occurs, not usable for effective lighting. Indeed, in this region, positive ions are accelerated with an energy of several hundred electron volts (eV) onto the cathode, thus allowing emission of secondary electrons, accelerated in the opposite direction, which allow ignition and maintenance of the glow discharge and of its positive column. The consequence is that the difference in voltage between the anode and the cathode is found in large part in the region of the cathode (cathode drop).

In other words, though the cathode region allows ignition, then maintenance of a glow discharge, it constitutes a region of high energy loss dissipated in ion bombardment of the cathode. Besides this major shortcoming in terms of energy efficiency, glow discharge lamps (neon or compact fluorescent) have several shortcomings, among them unreliable ignition (especially at low temperature) of current lamps based on rare gas mixtures; the difficulty, even impossibility of igniting discharges containing plasma gases other than rare gas mixtures; deterioration of the electrodes due to their ion bombardment (cathode drop); reduced lifetime, particularly in the case of frequent, repeated extinguishing and lighting; the impossibility of controlling lighting using a dimmer; the presence of mercury in the gas mixture, which poses a toxicity and recycling problem.

One aim of the invention is to propose a glow discharge lamp making it possible to avoid the energy loss due to the intense bombardment of the cathode (or more generally of the electrodes in the case where a periodic voltage is applied). In fact, improving the efficiency of glow discharge lamps constitutes one of the major challenges to be met so as to significantly reduce worldwide consumption of electricity for lighting, which at present corresponds to 16% of electricity production. Another goal of the invention is to provide a glow discharge lamp which makes it possible to correct, to the extent possible, the other shortcomings and flaws mentioned above.

SUMMARY

In accordance with the invention, a glow discharge lamp is proposed including:

- an elongated envelope transparent to the lighting radiation and containing a plasma gas,
- an application device for an electric field suited for maintaining a plasma in the region of the envelope called the positive column, that is the region wherein the axial electric field is constant, including two electrodes constituting an anode and a cathode situated inside the envelope, at each end of said envelope,
- a microwave or radio-frequency cathode plasma source positioned inside the envelope with respect to the electrode constituting the cathode so as to generate a localized high frequency (that is microwave or radio-frequency depending on the nature of the source) discharge on the surface of said electrode to generate said plasma.

It is from this cathode plasma, generated at the surface of the cathode, that the electrons are injected into the positive column. This cathode plasma source makes it possible to generate plasma without having to resort to a high cathode drop to produce secondary electrons. According to one embodiment, the lamp can be supplied with a periodic voltage at 50 or 60 Hz, so that each electrode alternately constitutes the cathode and the anode depending on the polarity of the applied voltage; the lamp can then include two alternating plasma sources situated in the envelope with respect to each of the two electrodes so as to generate a localized high-frequency discharge (radio-frequency or microwave depending on the nature of the source) at the surface of each of said electrodes.

According to certain embodiments, wherein the pressure in the envelope does not exceed a few torr (is less than 10 torr, that is), and is preferably less than or equal to 1 torr (1 torr=133 Pa):

- each cathode plasma source is an inductive radio-frequency source and the lamp further includes a device for applying a static axial magnetic field at said plasma source;
- each cathode plasma source is a microwave source and the lamp further includes a device for applying a static magnetic field the intensity whereof is equal to the electron cyclotron resonance intensity (that is the intensity for which the frequency of the microwave electric field is equal to the frequency of gyration of the electrons in the magnetic field) at said plasma source;
- the lamp further includes a device for applying a static axial magnetic field with intensity decreasing from the cathode toward the positive column, said axial magnetic field application device possibly including, for example, a solenoid wound around the cathode plasma source or permanent magnets providing an axial magnetic field (at least on the tube axis);
- the lamp further includes a device for applying an axial static magnetic field along the positive column, said static axial magnetic field application device possibly being a solenoid wound around the envelope.

According to one embodiment, the envelope takes the form of a straight tube. Alternatively, the envelope takes the form of a tube wound in a spiral or any other geometric shape, such as for example a circle or an oval.

Another object of the invention relates to a lighting method using a glow discharge lamp, said lamp including an elongated envelope, transparent to a lighting radiation and containing a plasma gas, and two electrodes constituting an anode and a cathode situated inside the envelope, at each end of the envelope, said method being characterized in that it includes:

- generation of a microwave or radio-frequency cathode plasma by means of a localized high-frequency discharge (microwave or radio-frequency) at the surface of the electrode constituting the cathode,
- application, between the anode and the cathode, of a voltage suited for applying an axial electric field for maintaining the plasma in the region of the envelope called the positive column.

The voltage applied between the electrodes is advantageously a DC voltage or a 50 Hz or 60 Hz AC voltage. According to one embodiment, the voltage applied is a 50 or 60 Hz AC voltage; the cathode plasma can then be generated alternately in the region of one or the other electrode, to wit the electrode constituting the cathode depending on the polarity of the voltage applied. Moreover, a static axial magnetic field, the intensity whereof decreases from the cathode toward the positive column, can also be applied at the cathode, at the surface whereof the cathode plasma is generated. On the other hand, a static axial magnetic field can also be applied along the positive column.

According to one embodiment, the plasma is a radio-frequency plasma, that is generated at a frequency comprised between 1 MHz and 100 MHz. A static axial magnetic field can then be applied at the cathode, at the surface whereof the cathode plasma is generated so as to obtain coupling in a helical mode.

According to another embodiment, the plasma is a microwave plasma, that is generated at a frequency comprised between 100 MHz and 5.8 GHz. A static magnetic field with an intensity equal to the electron cyclotron resonance intensity can then also be applied at the cathode, at the surface whereof the plasma is generated, so as to obtain an electron cyclotron resonance coupling. Advantageously, the pressure inside the envelope does not exceed a few torr (is less than 10 torr, that is) and is preferably less than or equal to 1 torr (133 Pa).

BRIEF DESCRIPTION OF THE DRAWINGS

Other features and advantages of the invention will emerge from the detailed description which follows, with reference to the appended drawings wherein.

DETAILED DESCRIPTION

In general terms, the lamp includes an elongated envelope containing a plasma gas. The envelope is transparent to the lighting radiation, which can be ultraviolet or visible radiation. If appropriate, the inner wall of the envelope can be at least partly covered with phosphors capable of converting the ultraviolet radiation provided by the glow discharge into visible radiation. The person skilled in the art is capable of selecting the material of the envelope and, if appropriate, suitable phosphors to allow transmission to the outside of the envelope of the lighting radiation which the lamp is required to supply. What is meant by "elongated" is the fact that the envelope has a greater dimension in one direction, called the axial direction, than in the two orthogonal directions, which define a radial direction.

Two electrodes are positioned within the envelope, at each end of said envelope, said ends being opposite to one another in the axial direction. Said electrodes are connected to a DC or a 50 or 60 Hz AC voltage source U. The envelope can have a substantially constant cross-section in the axial direction. Thus, said envelope can have a generally tubular shape.

Figure 2A:
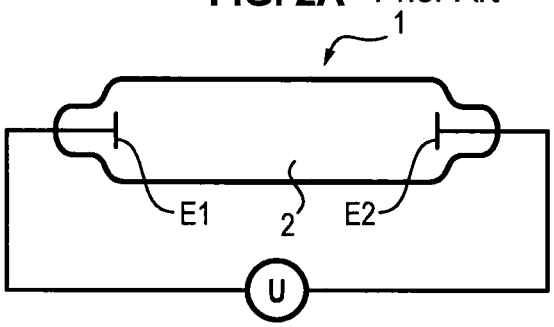
FIG. 2A Prior Art
FIGS. 2A and 2B illustrate two embodiments of the envelope, respectively forming a part of a neon tube and of a compact fluorescent bulb.

The envelope can be linear, meaning that it is substantially rectilinear in the axial direction. Such is the case with lamps called in current speech "neon tubes." An example of such an envelope is illustrated in FIG. 2A.

Figure 2B:
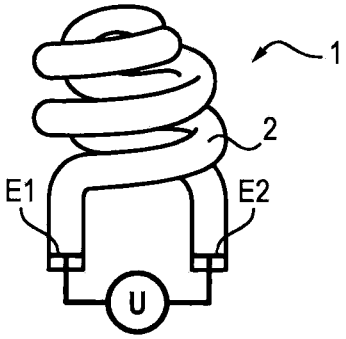
FIG. 2B Prior Art

Alternatively, the envelope can form a spiral (to form a circular or oval lamp) or a certain number of coils, as in the case of lamps called "compact fluorescent bulbs". An example of such a bulb is illustrated in FIG. 2B. Naturally, the envelope can be arranged in any other shape without thereby departing from the scope of the invention. In the case where the envelope is not linear, when speaking of the "axial direction" what is meant is the direction of the mean curve of the envelope.

The plasma gas can be any gas or gas mixture used for lighting. Thus, in a manner known in se, the plasma gas can be a mixture of rare gases (principally argon) seeded with mercury, the active element of which the principal emission lines are situated at 254 nm (the strongest line), 297 nm, 313 nm and 365 nm (UVA) (not an exhaustive list). The selection of the gas or gases and of possible active elements is carried out by the person skilled in the art depending on the wavelengths where emission is greatest according to the lighting radiation (UV or visible) that is desired.

In particular, to optimized the transmission of visible radiation from UV photon emissions, the selection of gases and active element is carried out so that the fluorescence efficiencies, that is of conversion of UV photos to visible light in phosphors lining the inside of the envelope, are highest. In conventional lamps, an appropriate voltage is applied between the two electrodes to generate a discharge in the plasma gas and thus to generate the plasma.

The invention proposes to replace the cathode drop region present in conventional lamps by a cathode plasma source suitable for generating the plasma in a localized manner at the surface of the cathode and to apply between the two electrodes an appropriate voltage for applying an axial electric field sufficient for maintaining the plasma thus generated in the positive column. The cathode plasma source, like the electrodes, is positioned inside the envelope. The plasma cathode source can be a microwave type or a radio-frequency (RF) inductive type source.

In the case of a lamp supplied with a periodic voltage (50 or 60 Hz for example), each electrode alternately constitutes the cathode or the anode depending on the polarity of the voltage applied. In this case, the invention proposes, in a preferred embodiment of the invention, to employ two cathode plasma sources placed at each of the two electrodes so as to alternately generate a high-frequency discharge at the surface of the electrode which constitutes the cathode. Nevertheless, due to a cost-effectiveness compromise to be respected, it is possible to place a plasma source at only a single electrode.

The invention makes it possible to reduce the power required for the discharge and for maintaining it, compared to known glow discharges. Indeed, the cathode plasma source can be a low-power source, to wit on the order of one watt, that is from a fraction of a watt to a few watts (depending on the cross-section of the lamp, for example for 1 $cm^2$). Moreover, by using a cathode plasma source at the cathode, bombardment of the cathode and the associated energy loss are avoided. Thus, it can be estimated that the invention provides a gain by a factor on the order of 2 to 4 in the power needed to maintain the discharge, compared to current glow discharges.

Figure 1:
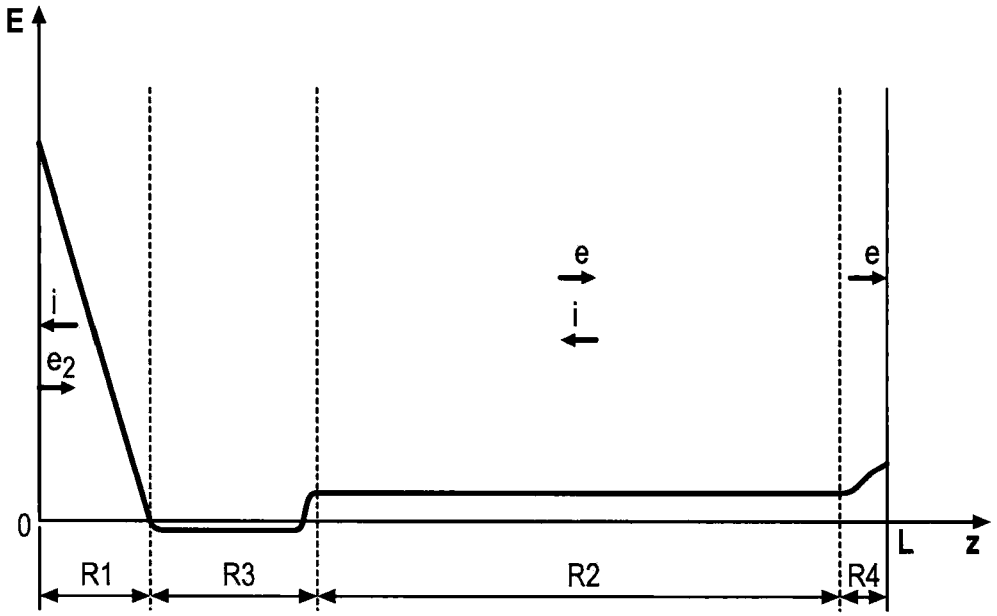
FIG. 1 Prior Art
FIG. 1 is a schematic of the electric field distribution inside of a DC neon tube type glow discharge lamp.
Figure 3:
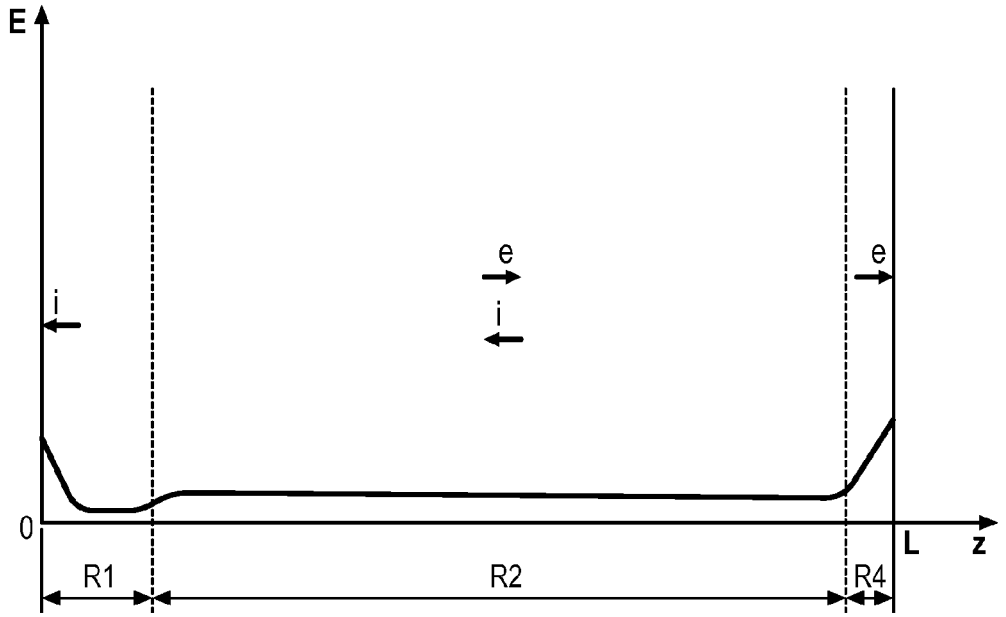
FIG. 3 is a schematic of the electric field distribution inside a neon tube type glow discharge lamp according to the invention.

By way of comparison with FIG. 1, FIG. 3 illustrates the electric field E distribution along a direct current glow discharge obtained by using a cathode plasma source as described above. The abscissa axis extends from the cathode (z=0) toward the anode (z=L, length of the tube); the ordinate axis is at the same scale as that of FIG. 1. In this configuration according to the invention, the cathode drop R1 and the negative glow R3 observed in FIG. 1 are replaced by a cathode plasma source R1 having a cathode drop that is sharply reduced compared to the cathode drop R1 of FIG. 1, because it is the electrons of the cathode plasma that are injected into the positive column (generation of the plasma in the positive column therefore does not require secondary electrons produced from the cathode drop).

In this case, firstly, the electric field within the cathode plasma is very weak and, secondly, the electric field within the cathode drop R1 of the cathode plasma is reduced by a considerable factor (greater than a factor of 2 to 4) compared to the electric field encountered, in the same region, in the case illustrated in FIG. 1. Moreover, the negative glow region (R3 in FIG. 1) no longer appears, the positive column R2 extending all the way to the cathode plasma source R1 (in fact, in FIG. 3, no discontinuity is observed between the cathode plasma source and the positive column, as is the case in the presence of a negative glow). For its part, the anode sheath R4 is unchanged.

In the first place, the invention makes it possible to considerably reduce energy losses due to ion bombardment of the cathodes in current glow discharges. In addition, the invention makes it possible to correct most of the shortcomings of current glow discharges. In fact, the invention provides a long lifetime for glow discharge lamps, sputtering of the electrodes due to ion bombardment being prevented.

Moreover, the lamps according to the invention can operate under extended operating conditions, in terms of the frequency of the electromagnetic wave, of power, of pressure and of the type of gas, tied to those of the cathode plasma source. It then becomes possible to use a plasma gas without mercury, which eliminates its toxicity and facilitates recycling of the lamp. The invention also allows operation of the lamp under extreme conditions.

On the other hand, thanks to the wide range of coupling modes that are possible, and the possibility of pulse modulation, the cathode plasma source is able to ignite immediately. Thus it allows immediate ignition of the glow discharge. Moreover, use of a dimmer is possible with the lamp according to the invention.

Finally, certain microwave plasma sources make it possible to limit radiation, the absorption of microwaves taking place immediately following exit from the applicator and ignition being immediate. Otherwise, it is imperative to use electromagnetic shielding.

Figure 4:
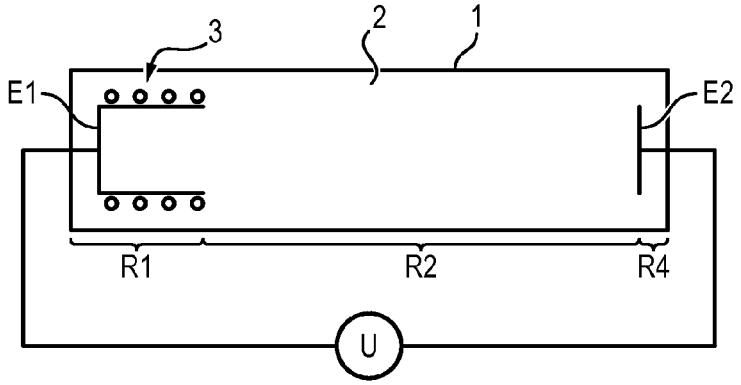
FIG. 4 is an outline schematic of a glow discharge lamp according to a first embodiment of the invention, wherein the cathode plasma is excited at radio frequency.

FIG. 4 illustrates an embodiment of the invention wherein the glow discharge is initiated starting with an RF type inductive plasma produced by a source 3 at the surface of one of the electrodes playing the part of the cathode (in the example illustrated, this is electrode E1). Moreover, the glow discharge is maintained by the application of a voltage U between electrodes E1 and E2. As stated above, the voltage applied can be continuous or periodic (for example at 50 or 60 Hz). Typically, so-called "inductive" RF plasmas are generated at frequencies which can cover the range from the order of MHz to hundreds of MHz, and in particular at the ISM (industrial, scientific, medical) frequencies such as 13.56 MHz, 27.12 MHz or 40.68 MHz and with highly varied antenna geometries, well known in the state of the art of inductive plasmas.

Figure 5:
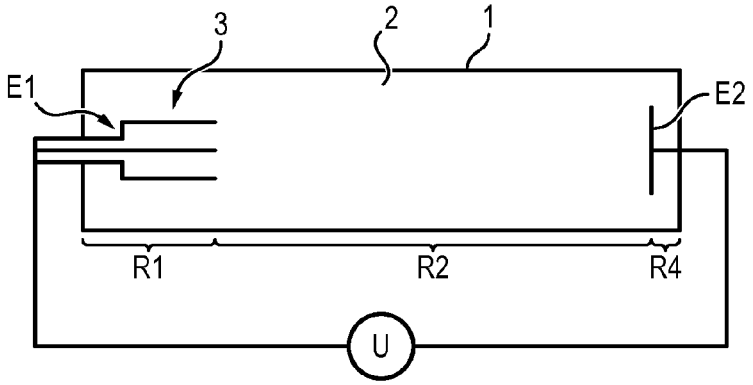
FIG. 5 is an outline schematic of a glow discharge lamp according to a second embodiment of the invention, wherein the cathode plasma is excited by microwaves.

FIG. 5 illustrates another embodiment of the invention, wherein the glow discharge is initiated starting with a microwave plasma produced by a source 3 on the surface of one of the electrodes playing the part of the cathode (in the example illustrated, this is electrode E1). Said source 3 can be a cavity containing an antenna, or a coaxial structure consisting of a central conductive core and of an outer conductor delimiting a volume for propagation of the microwaves. Moreover, the glow discharge is maintained by applying a voltage U between electrodes E1 and E2.

As stated above, the voltage applied can be continuous or periodic (for example at 50 or 60 Hz). So-called "microwave" plasmas can be generated at frequencies which can range from hundreds of MHz to a few GHz, and in particular at the ISM frequencies of 433 MHz, 2.45 GHz, or even 5.80 GHz. In the example illustrated in FIG. 5, where the plasma is generated in an Evenson type $\lambda/4$ cavity [1], miniaturization of the source compels operation at high frequencies (2.45 or 5.80 GHz). By contrast, at lower microwave frequencies, it is possible to operate with coaxial applicator type sources (see for example references [2]-[3]) where the microwave power is absorbed immediately upon leaving the applicator, or with surface wave type plasma sources.

A certain number of improvements according to the invention can be accomplished through the use of magnetic fields, either at the plasma source or sources, or at the positive column. These improvements involve operating at pressures not exceeding a few torr (that is less than 10 torr), and preferably less than one torr (1 torr=133 Pascal), a pressure range where the electron collision frequency v in the plasma becomes less than the cyclotron frequency $\omega_{ce}$ of the electrons in the magnetic field ($v<\omega_{ce}$). Indeed, if this were not the case, the effect of the magnetic field would be strongly damped by collisions.

RF Source in Helical Coupling Mode

This embodiment relates to RF inductive type plasma sources which can operate in different coupling modes called respectively:

- mode E or low-density electrostatic mode;
- mode H or high-density inductive mode, and
- mode W or helical mode in the presence of an axial magnetic field applied to the discharge.

The name of this helical coupling mode is derived from the supposed propagation mode of the wave in the presence of a magnetic field [4]. This helical mode makes it possible to attain higher densities at a given RF power due, on the one hand to the confinement resulting from the magnetic field and, on the other hand, to the very effective mode for coupling RF power to the plasma.

Figure 6:
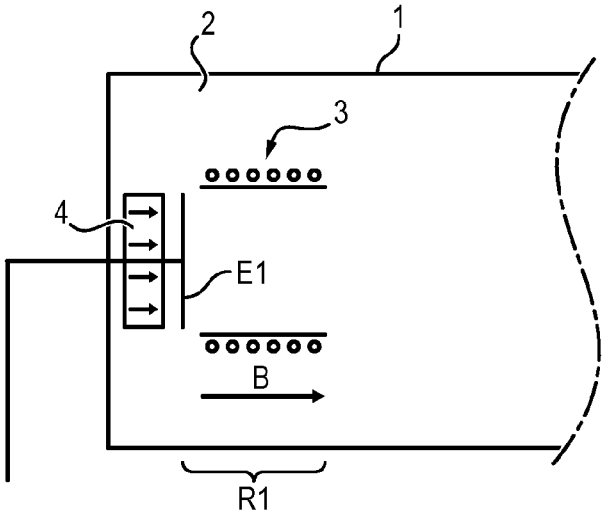
FIG. 6 illustrates schematically an embodiment wherein a static axial magnetic field, designed to provide a helical coupling mode, is applied in the region where the radio-frequency cathode plasma is generated.

According to this embodiment, illustrated in FIG. 6, a static axial magnetic field B is applied to the surface of the RF inductive type plasma source 3 so as to obtain mode W coupling. The intensity of such a magnetic field is on the order of a hundred gauss. This magnetic field can be obtained, in a manner known in se, from permanent magnets and/or from magnetic coils or solenoids. In the example illustrated in FIG. 6, the magnetic field is provided by a permanent magnet 4 for with axial magnetization placed in proximity to the cathode.

Microwave Source in ECR (Electron Cyclotron Resonance) Coupling Mode

This embodiment relates to microwave type plasma sources which, in the presence of a static magnetic field, can operate in a resonant coupling mode called electron cyclotron resonance (ECR). Electron cyclotron resonance is obtained when the frequency $f_0=\omega_0/2\pi$ of the microwave electric field applied is equal to the frequency $f_{ce}=\omega_{ce}/2\pi$ of gyration of the electrons in the magnetic field, i.e. $\omega_0=\omega_{ce}$. For a given microwave frequency, the intensity of the magnetic field $B_0$ needed for ECR coupling is therefore:

$$B_0=f_0 2\pi m_e/e \quad (1)$$

where $m_e$ is the mass of the electron, and $-e$ is its charge.

According to this embodiment, a static magnetic field with an intensity equal to the resonance value $B_0$ is applied at the plasma source so as to obtain the ECR coupling mode. For exciting the plasma at ECR by microwaves at 2.45 GHz, the intensity of the magnetic field is $B_0$=0.0875 tesla. This intensity of the static magnetic field can be obtained by magnetic coils or solenoids, and/or from permanent magnets.

In particular, conventional permanent magnets made of samarium-cobalt or of barium and strontium ferrite make it possible to obtain the magnetic field intensity required for ECR coupling. In the case of lower frequency microwaves, the intensity of the resonance magnetic field required is weaker. Thus, $B_0$=0.0155 tesla at 433 MHz. The magnetic field applied is preferably axial.

Figure 7:
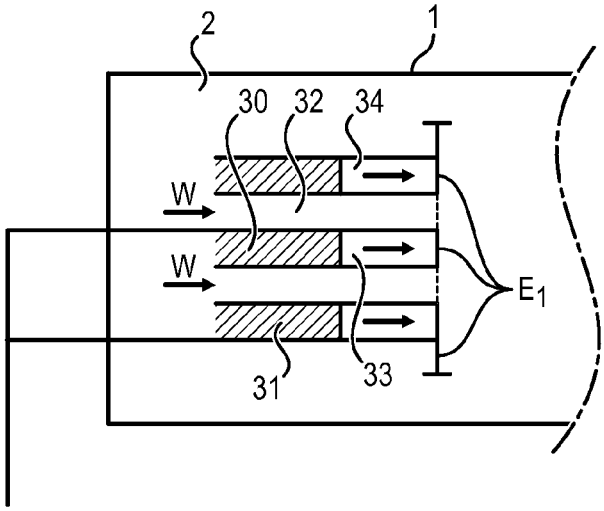
FIG. 7 illustrates schematically a microwave cathode plasma applicator also allowing application of a static magnetic field providing an electron cyclotron resonance coupling mode.

According to a particular embodiment illustrated in FIG. 7, the plasma source is a coaxial microwave applicator including a central core 30 and an outer conductor 31 separated by a volume 32 for propagation of the microwave, which further includes:

- a cylindrical permanent magnet 33, positioned at the end of the central core 30 with its magnetization direction parallel to the axis of the applicator; said magnet 33 preferably has a radius substantially identical to that of the central core (concretely, said magnet can have a radius slightly smaller than that of the central core and be accommodated in a cylindrical recess provided at the end of the central core);
- an annular magnet 34, positioned at the end of the outer conductor 31 of the coaxial assembly and with its magnetization direction parallel to the axis of the applicator and concurrent with that of the cylindrical magnet.

All the magnets arranged at the end of the applicator have the same magnetization direction. Preferably, said annular magnet 34 has an inner radius equal to that of the outer conductor 31, which corresponds to the outer radius of the annular volume 32 for propagation of the microwaves, denoted R (concretely, said magnet 34 can have an inner radius slightly greater than that of the outer conductor and an outer radius slightly smaller than that of the outer conductor, and be accommodated in an annular recess provided at the end of the outer conductor). The magnets 33, 34 can be permanently attached to the coaxial assembly by any appropriate means.

The magnetization of the cylindrical magnet 33 and of the annular magnet 34 is chosen so as to form a magnetic field capable of providing, in a region remote from the exit plane of the applicator, electron cyclotron resonance coupling with the microwave electric field generated by the applicator. This assumes that the magnetization of said magnets 33, 34 is sufficient for generating, at a distance from the exit plane of the applicator, a magnetic field having the intensity $B_0$ allowing electron cyclotron resonance corresponding to the microwave frequency provided, according to formula (1) above.

Furthermore, the cylindrical magnet 33 and the annular magnet 34 make it possible to generate magnetic field lines which pass through the electron cyclotron resonance coupling region in a direction substantially parallel to the axis of the applicator. This effect can be obtained by a judicious selection of the outer radius and of the magnetization of the annular magnet 34. Indeed, the greater the outer diameter of the annular magnet 34, the more the constant-intensity lines of the magnetic field generated remotely from the applicator remain parallel to the exit plane of the applicator over a considerable radius.

The electron cyclotron resonance region being delimited, in the radial direction, by the region wherein the microwave electric field is strongest, the use of an annular magnet with an outer radius much greater than the radius of this region makes it possible to obtain an ECR region substantially parallel to the exit plane of the applicator. It is considered that this strong electric field region extends over a radius on the order of twice the radius R of the applicator. Consequently, if the annular magnet has an outer radius greater than the radius of the strong electric field region, the ECR region is substantially parallel to the exit plane of the applicator over its entire extent of radius 2R.

Moreover, due to the presence of the annular magnet having an outer radius greater than 2R, the field lines departing the pole situated at the exit plane of the applicator to reach the opposite pole remain substantially parallel to the axis of the applicator during their passage through the ECR region of radius 2R, including the periphery of that zone. In other words, the annular magnet has the effect of "straightening" the field lines at the periphery of the ECR region.

Figure 8:
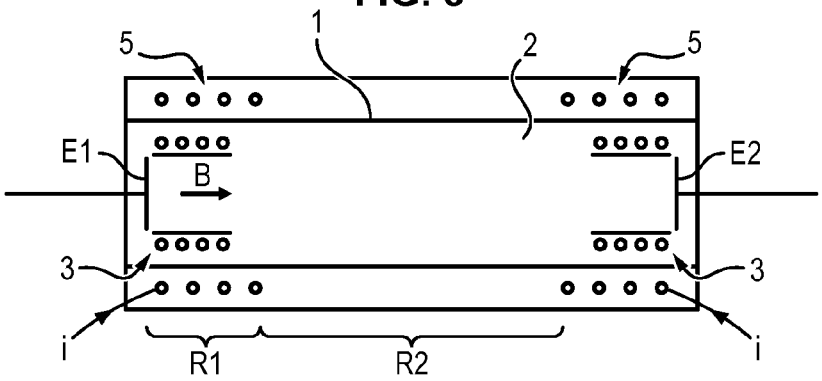
FIG. 8 illustrates schematically an embodiment wherein a static magnetic field gradient decreasing from the cathode toward the positive column is applied in the region where the cathode plasma is generated.

Application of a Static Magnetic Field Gradient from the Electrode Toward the Positive Column According to one embodiment, illustrated in FIG. 8, a static axial magnetic field is applied in the region R1 of the plasma source or sources at an amplitude which, in the source region, decreases continuously from the cathode toward the positive column. Such a static magnetic field can be generated, for example, by a solenoid 5 the coils whereof are separated by a pitch that increases from the cathode toward the positive column.

The current circulating in said solenoid can be supplied, for example by the power supply to the transistors of the plasma source or sources. This is therefore a direct current. Thanks to this decreasing magnetic field gradient, the electrons accelerated in the plasma source convert, in the magnetic field gradient, the rotation speed acquired at the source into translation speed in the direction of the positive column due to conservation of the magnetic moment of the electron along its trajectory (first adiabatic invariant). Due to the electric space charge, the ions are driven by the electrons so that the plasma produced in the plasma source or sources at the cathode is "injected" toward the positive column.

This embodiment applies both to microwave and to RF plasma sources. The solenoid 5 being advantageously placed outside the plasma and surrounding the cathode plasma source 3, it also performs the function of electromagnetic shielding with respect to microwave or RF waves. In the example illustrated here, an RF plasma source 3 is placed in the region of each electrode and a solenoid 5 is placed around each of these sources, but it goes without saying that this embodiment can be implemented with single cathode plasma source and a single solenoid surrounding it.

Application of a Static Axial Magnetic Field Along the Positive Column

Figure 9:
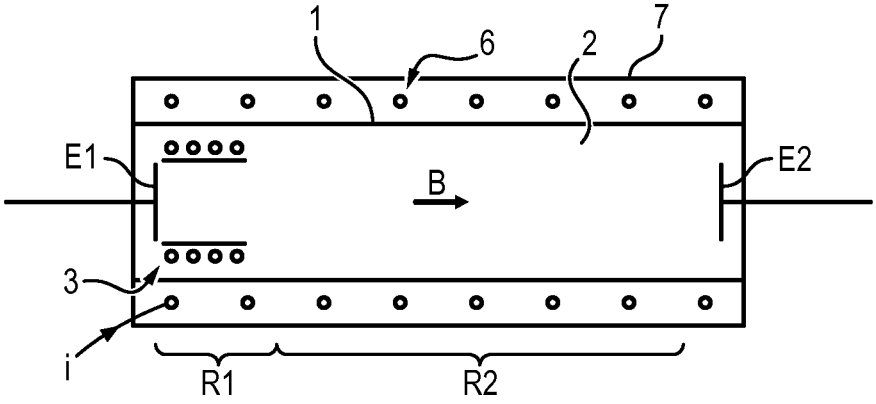
FIG. 9 illustrates schematically an embodiment wherein a conductive solenoid is wound all along the positive column so as to apply a static axial magnetic field to it.

According to one embodiment, a static axial magnetic field is applied along the positive column so as to reduce the radial losses along the positive column, and thus to improve the overall energy efficiency of the glow discharge. As illustrated in FIG. 9, this static magnetic field can be obtained by a direct current circulating in a conductive winding of the solenoid type 6 surrounding the glow discharge over its entire length. In the example illustrated here, the solenoid 6 is wound outside the tube 1, inside a tube 7, transparent to the emitted radiation, which contains the tube 1. If, however, the solenoid 6 is electrically insulated, it can be placed inside the tube 1, in proximity to its inner wall.

The space between each coil of the winding must of course be sufficient to allow passage of the light to the outside. The direct current circulating in the winding can for example be supplied by the power supply to the transistors of the plasma sources at the ends of the glow discharge. Besides the confinement effect, the winding can also, if necessary, provide shielding from the electromagnetic waves emitted by certain plasma sources.

This embodiment applies both to microwave and to RF plasma sources. In the example illustrated here an RF plasma source 3 is placed in the region of only one electrode (E1), but it goes without saying that this embodiment can be implemented with two cathode plasma sources. Moreover, the different embodiments described above can possibly be combined.

In particular, it is possible to combine the embodiments illustrated in FIGS. 8 and 9 by positioning along the glow discharge a solenoid wherein the pitch of the coils increases from the cathode to the positive column, and is constant along the positive column. Thus, thanks to such a solenoid, a magnetic field gradient in the cathode region and a constant-intensity magnetic field in the positive column are both generated.

REFERENCES

[1] F. C. Fehsenfeld, K. M. Evenson, H. P. Broida, Microwave Discharge Cavities Operating at 2450 MHz, Rev. Sci. Instr. 36, 294-298 (1965)

[2] T. Lagarde, A. Lacoste, J. Pelletier, Y. Arnal, Dispositif de production d'une nappe de plasma [Device for producing a plasma layer], FR 2 840 451

[3] L. Latrasse, A. Lacoste, J. Sirou, J. Pelletier, High density distributed microwave plasma sources in a matrix configuration: concept, design and performance, Plasma Sources Sci. Technol. 16, 7-12 (2007)

[4] Francis F. Chen, Plasma ionization by helicon waves, Plasma Physics and Controlled Fusion, 33, 339-364 (1991)

The invention claimed is:

1. A glow discharge lamp comprising:

an elongated envelope, transparent to lighting radiation and containing a plasma gas;

a device for applying an electric field suitable for maintaining a plasma in a region of the envelope called a positive column, including two electrodes constituting an anode and a cathode situated in the envelope, at each end of the envelope; and a microwave or radio-frequency cathode plasma source positioned in the envelope relative to the electrode constituting the cathode so as to generate a localized high-frequency discharge on the surface of the electrode to generate the plasma.

2. The lamp of claim 1, which is supplied with a periodic voltage at 50 Hz or 60 Hz, the lamp further comprising two cathode plasma sources situated in the envelope relative to each of the two electrodes so as to generate a localized radio-frequency or microwave plasma at the surface of each of the electrodes.

3. The lamp of claim 1, wherein the cathode plasma source is an inductive radio-frequency source.

4. The lamp of claim 1, wherein the cathode plasma source is a microwave source.

5. The lamp of claim 1, wherein a pressure inside the envelope is less than 10 torr (1330 Pa).

6. The lamp of claim 5, wherein the cathode plasma source is an inductive radio-frequency source and the lamp further includes a device for applying a static axial magnetic field at the plasma source.

7. The lamp of claim 5, wherein the cathode plasma source is a microwave source and the lamp further includes a device for applying a static magnetic field with intensity equal to an electron cyclotron resonance intensity at the plasma source.

8. The lamp of claim 6, further comprising a device for applying, at the cathode, a static axial magnetic field with its intensity decreasing from the cathode toward the positive column.

9. The lamp of claim 6, further comprising a device for applying a static axial magnetic field along the positive column.

10. The lamp of claim 9, wherein the device for applying a static axial magnetic field is a solenoid wound around the envelope.

11. The lamp of claim 1, wherein the envelope takes the form of a straight tube.

12. The lamp of claim 1, wherein the envelope takes the form of a tube wound in a spiral.

13. A lighting method using a glow discharge lamp, the lamp comprising an elongated envelope transparent to lighting radiation and containing a plasma gas (2), and two electrodes constituting an anode and a cathode, situated inside the envelope, at each end of the envelope, the method comprising:

generating a microwave or radio-frequency cathode plasma by a localized high-frequency discharge at the surface of the electrode constituting the cathode, the discharge being created by a microwave or radio-frequency cathode plasma source positioned in the envelope; and applying, between the anode and the cathode, a voltage suited for applying an axial electric field for maintaining the plasma in a region of the envelope called a positive column.

14. The method of claim 13, wherein the voltage applied is an AC voltage at 50 or 60 Hz and the cathode plasma is generated alternately at the surface of one and the other electrode, to with the electrode constituting the cathode depending on the polarity of the voltage applied.

15. The method of claim 13, wherein a static axial magnetic field, with its intensity decreasing from the cathode toward the positive column, is further applied at the cathode at the surface whereof the cathode plasma is generated.

16. The method of claim 13, wherein a static axial magnetic field is further applied along the positive column.

17. The method of claim 13, wherein the cathode plasma is generated at a frequency comprised between 1 MHz and 100 MHz.

18. The method of claim 17, wherein a static axial magnetic field is further applied at the cathode, at the surface whereof the cathode plasma is generated, so as to obtain coupling in a helical mode.

19. The method of claim 13, wherein the cathode plasma is generated at a frequency comprised between 100 MHz and 5.8 GHz.

20. The method of claim 19, wherein a static magnetic field with an intensity equal to an electron cyclotron resonance intensity is further applied at the cathode at the surface whereof the cathode plasma is generated, so as to obtain electron cyclotron resonance coupling.

21. The method of claim 13, wherein a pressure in the envelope is less than 10 torr (1330 Pa).

22. The method of claim 13, wherein the voltage applied between the electrodes is a DC voltage or an AC voltage at 50 Hz or 60 Hz.

* * * * *